US011390938B2

(12) United States Patent
Xue et al.

(10) Patent No.: US 11,390,938 B2
(45) Date of Patent: Jul. 19, 2022

(54) PRECIPITATION STRENGTHENING ALCRFENIV SYSTEM HIGH ENTROPY ALLOY AND MANUFACTURING METHOD THEREOF

(71) Applicant: BEIJING INSTITUTE OF TECHNOLOGY, Beijing (CN)

(72) Inventors: Yunfei Xue, Beijing (CN); Linjing Wang, Beijing (CN); Benpeng Wang, Beijing (CN); Qian Xiao, Beijing (CN); Lilun Geng, Beijing (CN); Lu Wang, Beijing (CN); Fuchi Wang, Beijing (CN)

(73) Assignee: BEIJING INSTITUTE OF TECHNOLOGY, Beijing (CN)

( * ) Notice: Subject to any disclaimer, the term of this patent is extended or adjusted under 35 U.S.C. 154(b) by 92 days.

(21) Appl. No.: 16/409,531

(22) Filed: May 10, 2019

(65) Prior Publication Data

US 2020/0308683 A1 Oct. 1, 2020

Related U.S. Application Data

(63) Continuation of application No. PCT/CN2018/000105, filed on Mar. 16, 2018.

(30) Foreign Application Priority Data

Dec. 29, 2017 (CN) ..... 201711473395.7

(51) Int. Cl.

| | |
|---|---|
| ***C22F 1/10*** | (2006.01) |
| ***C22C 1/02*** | (2006.01) |
| ***C22C 19/05*** | (2006.01) |
| ***C22C 30/00*** | (2006.01) |
| ***C22F 1/02*** | (2006.01) |

(52) U.S. Cl.

CPC ..... *C22F 1/10* (2013.01); *C22C 1/023* (2013.01); *C22C 19/058* (2013.01); *C22C 30/00* (2013.01); *C22F 1/02* (2013.01)

(58) Field of Classification Search

None

See application file for complete search history.

(56) References Cited

FOREIGN PATENT DOCUMENTS

CN 105755324 A * 7/2016

OTHER PUBLICATIONS

English language machine translation of CN-105755324-A to Ma et al. Generated Feb. 24, 2021. (Year: 2021).*

* cited by examiner

*Primary Examiner* — Brian D Walck

(74) *Attorney, Agent, or Firm* — Yong Chen

(57) ABSTRACT

A precipitation strengthening AlCrFeNiV system high entropy alloy is composed of Al 0.30-0.60, Cr 0.20-0.89, Fe 0.60-1.20, Ni 1.50-3.50 and V 0.10-0.30 by weight ratio. The high entropy alloy is manufactured utilizing melting and casting, followed by deformation and heat treatment process.

1 Claim, 4 Drawing Sheets

PRECIPITATION STRENGTHENING ALCRFENIV SYSTEM HIGH ENTROPY ALLOY AND MANUFACTURING METHOD THEREOF

CROSS REFERENCE TO RELATED APPLICATIONS

This application is a continuation of International application PCT/CN2018/000105, filed on Mar. 16, 2018, which claims priority to Chinese Patent Application No. 201711473395.7, filed Dec. 29, 2017, the disclosure of each of which is incorporated herein by reference in its entirety.

TECHNICAL FIELD

The present invention relates to a precipitation strengthening AlCrFeNiV system high entropy alloy and manufacturing method thereof, which belongs to the technical field of metal materials.

BACKGROUND

High entropy alloy, which revolutionizes the design concept of the traditional alloy that includes a single principal element and a small number of alloying elements, consists of multiple principal elements with concentration of 5%~35% and with or without minor elements less than 5%. Compared with traditional alloys, high entropy alloys exhibit excellent strength, hardness, wear resistance, corrosion resistance and thermal stability due to their high entropy effect, sluggish diffusion effect, lattice distortion effect and cocktail effect.

Although high entropy alloys possess overall excellent properties, the previously reported high entropy alloy with FCC single-phase structure usually has low strength, which has greatly restricted the engineering application of this kind of high entropy alloy. For example, the tensile strength of the CoCrFeNiMn high entropy alloy with FCC structure only reaches 400 MPa. It has been reported that nanoscale coherent precipitation phase can be introduced into the FCC matrix to improve its strength. For example, by adding small amounts of Ti and Al to the single FCC phase CoCrFeNi high entropy alloy, combining with thermomechanical processing, a great deal of nanoscale $Ni_3Al$ with $L1_2$ structure precipitates coherently with the FCC matrix, which substantially increases the yield strength of the alloy to 1005 MPa. However, there are still a large amount of brittle Laves phase in this alloy, which impose restrictions on the further improvement of the alloy strength.

SUMMARY

In view of the relatively low strength of the existing FCC structure high entropy alloy, an object of the invention is to provide a type of precipitation strengthening AlCrFeNiV system high entropy alloy and manufacturing method thereof. Such high entropy alloy is manufactured utilizing melting and casting processing followed by deformation and heat treatment processing, leading to the formation of a coherent spinodal microstructure of the disordered FCC phase and ordered $L1_2$ phase. The grain size of the alloy is very small (less than 10 μm), and the strength of the high-entropy alloy is significantly improved.

The purpose of the present invention is implemented by the following technical solution.

A precipitation strengthening AlCrFeNiV system high entropy alloy according to the present invention, wherein the chemical formula of high entropy alloy is described as $Al_aCr_bFe_cNi_dV_e$, where a=0.30-0.60, b=0.20-0.89, c=0.60-1.20, d=1.50-3.50, e=0.10-0.30.

Further, the values of a, b, c, d and e are preferably a=0.30-0.55, b=0.30-0.70, c=0.60-1.10, d=2.00-3.50, e=0.10-0.22.

The invention provides a manufacturing method for the precipitation strengthening AlCrFeNiV system high entropy alloy, and the method includes the following steps:

(1) The metal elements Al, Cr, Fe, Ni and V are selected as raw materials, and the metal elements are heated to melt and alloyed to obtain a master alloy ingot under the protection of argon; then the master alloy ingot is heated to melt and cast to get the high entropy alloy ingot under the protection of argon;

(2) The high entropy alloy ingot is cleaned and placed in a vacuum or argon atmosphere, and is then heated to a temperature between 1000° C. and ($T_m$−100° C.) for solution treatment for 12 h or more; then the treated high entropy alloy ingot is further subjected to deformation treatment with a total deformation of 50%-90%; finally, the deformed ingot is subjected to an aging treatment at a temperature of 500° C.-900° C. for 1 h-50 h to obtain the high entropy alloy.

In this method, the purity of the metal elements Al, Cr, Fe, Ni and V is not less than 99.5 wt. %; $T_m$ is the melting point of the high entropy alloy ingot; the mode of deformation treatment includes rolling, die forging, rotary forging, or combined deformation of die forging and rotary forging.

Beneficial Effects (1) The high entropy alloy according to the present invention has a high content of Ni and Fe, both of which are stable components of FCC phase, ensuring that the high entropy alloy is primarily composed of an FCC phase. Meanwhile, the high Ni content and relatively low Al content in the high entropy alloy contribute to the formation of $L1_2$ phase and avoid the precipitation of B2 phase. The high melting point of V and large negative mixing enthalpy between Ni and V both promote the formation of $L1_2$ phase. In addition, the low Cr content and small V content in the present high entropy alloy can effectively avoid the formation of the hard and brittle σ phase, and the low Cr content can effectively reduce or avoid the formation of Cr-rich lath-shaped BCC phase, both providing large promotion space for the strength of the high entropy alloy.

(2) The high entropy alloy according to the present invention is mainly composed of FCC phase, with a large number of nanoscale $L1_2$ phase precipitated coherently with the FCC matrix, which significantly improves the strength of high entropy alloy, with the yield strength of more than 1200 MPa and tensile strength of more than 1300 MPa.

DETAILED DESCRIPTION

Figure 1:
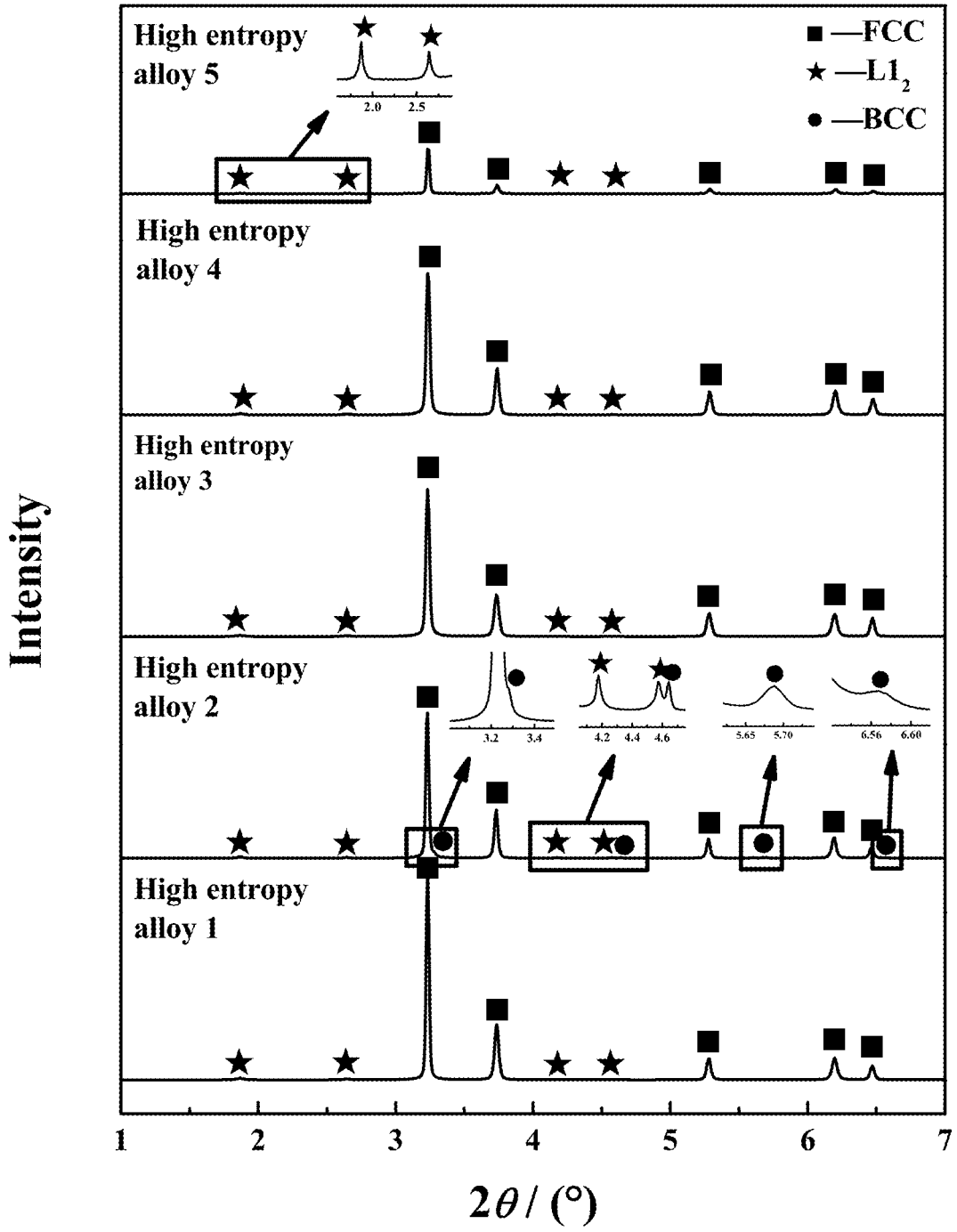
FIG. 1 is a comparison diagram of the X-ray diffraction (XRD) spectra of the high entropy alloys 1~5 prepared in examples 1~5.

The present invention will be further described below with reference to the accompanying drawings and specific examples. Wherein, the method is a conventional method unless otherwise specified, and the raw materials can be obtained from publicly available commercial approaches unless otherwise specified.

In the following examples:

The purity of the metal elements Al, Cr, Fe, Ni and V are all 99.9 wt. %;

High purity argon: purity greater than 99.99 wt. %;

High vacuum non-consumable arc melting furnace: DHL-400 type, Sky Technology Development Co., Ltd., Chinese Academy of Sciences;

High vacuum arc melting and casting system: Shenyang Haozhiduo New Material Preparation Technology Co., Ltd.;

A copper mold with a chamber having a rectangular cross section, and the size of the chamber is 50 mm×13 mm×50 mm (i.e., length×width×height).

The mechanical property test and microstructure characterization of the high entropy alloys prepared in the examples were conducted as follows:

(1) Phase analysis: The phase structure of the high entropy alloys was analyzed by a synchrotron-based high-energy X-ray diffraction technique, at the 11-ID-C beam line of the Advanced Photon Source, Argonne National Laboratory, USA. The wavelength $\lambda$ of the high energy X-ray is 0.011725 nm;

(2) Microstructure characterization: The microstructure of the high entropy alloys was characterized using the HITACHIS 4800 cold field emission scanning electron microscope.

(3) Quasi-static tensile mechanical property test: The tensile mechanical property tests were carried out employing a CMT4305 universal electronic tensile testing machine at room temperature using a nominal strain rate of $1\times10^{-3}$ $s^{-1}$. The test specimens were machined to dog-bone shape with a gauge length of 10 mm, a width of 3.14 mm and a thickness of 1 mm according to the Chinese national standard (GB/T228.1-2010) "metallic materials tensile testing at ambient temperature".

Example 1

The specific preparation steps of the high entropy alloy $Al_{0.38}Cr_{0.69}Fe_{0.6}Ni_{2.12}V_{0.17}$ (hereinafter referred to as high entropy alloy 1) are as follows:

(1) Raw material preparation: The pure metals Al, Cr, Fe, Ni and V were grinded to remove oxides and other impurities on the surfaces using sandpapers with a grinding machine, and were then successively cleaned with acetone and ethanol by ultrasonic cleaning machines to obtain clean metal elements. Afterwards, the pure metals were accurately weighed according to the chemical formula of the high entropy alloy in this example for a total mass of 80 g.

(2) Melting: The cleaned pure metals were stacked inside the water-cooled copper crucible of the high vacuum non-consumable arc melting furnace from bottom to top according to the order of their respective melting points from low to high. Then the furnace chamber was evacuated to $2.5\times10^{-3}$ Pa and filled with high purity argon gas as protective gas. The pure Ti ingot was first melted to further reduce the oxygen content in the furnace chamber, and then the melting of the alloy was carried out with a melting current ranging from 20 A to 500 A. During the melting process, electromagnetic stirring was used to homogenize the alloy. After the alloy ingot was cooled, the alloy ingot was flipped and remelted for 4 times to obtain a master alloy ingot.

(3) Casting: The master alloy ingot was placed in the high vacuum arc melting and casting apparatus, and the furnace chamber was evacuated to $2.5\times10^{-3}$ Pa and filled with high purity argon gas. Under the protection of argon, the master alloy ingot was heated to 1600° C. with a melting current ranging from 20 A to 500 A. After the master alloy ingot was completely melted, the liquid alloy was cast into a copper mold and cooled to obtain a high entropy alloy ingot.

(4) Solution treatment: The high entropy alloy ingot was cleaned with acetone by ultrasonic cleaning machines, and then vacuum-sealed and filled with argon. The high entropy alloy ingot was heated to 1200° C. at a heating rate of 10° C./min in a furnace, and held at that temperature for 24 h. Thereafter, the sample was taken out and water quenched to obtain a solid solution state high entropy alloy.

(5) Deformation treatment: The solid solution state high entropy alloy was deformed by rolling at room temperature by multi-pass rolling with 0.5 mm reduction in each pass and a rolling speed of 0.1 m/s for a total deformation of 70%, thereby obtaining a rolled high entropy alloy.

(6) Aging treatment: The rolled high entropy alloy was subjected to heat treatment for 10 h at 700° C., and then air-cooled to obtain the high entropy alloy 1.

Figure 2:
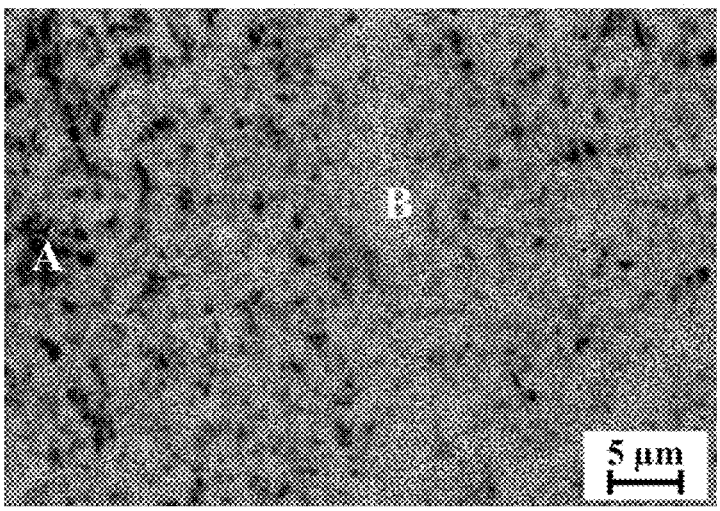
FIG. 2 is a scanning electron microscope image of the high entropy alloy 1 prepared in the example 1.
Figure 7:
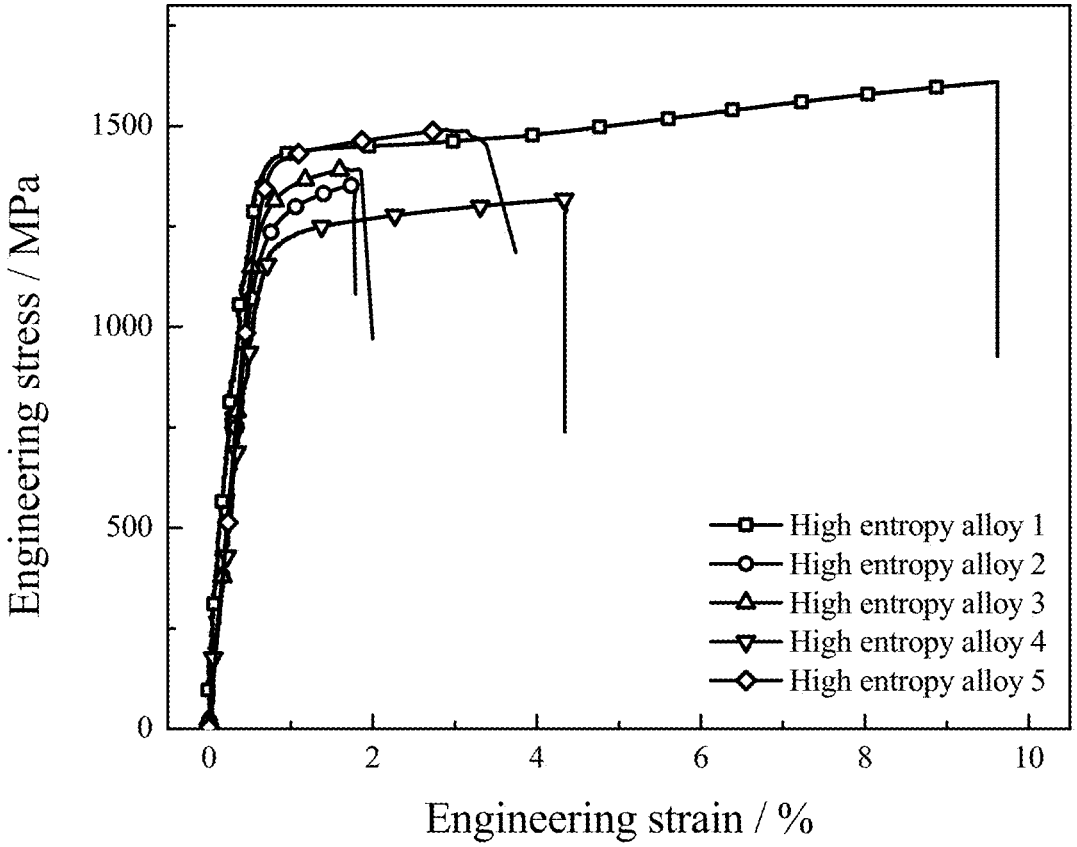
FIG. 7 is a comparison diagram of the tensile stress-strain curves of the high entropy alloys 1~5 prepared in examples 1~5.

It can be seen from the XRD spectrum shown in FIG. 1 that the prepared high entropy alloy 1 is composed of FCC phase and $L1_2$ phase. As can be seen from the SEM image shown in FIG. 2, the prepared high entropy alloy 1 is composed of two regions of A and B and the average grain size is 0.7 μm. Region A is the matrix FCC phase, and region B is a region where the FCC phase and the $L1_2$ phase are alternately arranged. According to the results of the quasi-static tensile mechanical property tests in FIG. 7 and Table 1, the prepared high entropy alloy 1 possesses a tensile yield strength of 1426 MPa, a tensile strength of 1609 MPa and an elongation of 10% at room temperature.

Example 2

The specific preparation steps of the high entropy alloy $Al_{0.6}Cr_{0.84}Fe_{1.2}Ni_3V_{0.24}$ (hereinafter referred to as high entropy alloy 2) are as follows:

(1) Raw material preparation: The pure metals Al, Cr, Fe, Ni and V were grinded to remove oxides and other impurities on the surfaces using sandpapers with a grinding machine, and were then successively cleaned with acetone and ethanol by ultrasonic cleaning machines to obtain clean metal elements. Afterwards, the pure metals were accurately weighed according to the chemical formula of the high entropy alloy in this example for a total mass of 80 g.

(2) Melting: The cleaned pure metals are stacked inside the water-cooled copper crucible of the high vacuum non-consumable arc melting furnace from bottom to top according to the order of their respective melting points from low to high. Then the furnace chamber was evacuated to $2.5\times10^{-3}$ Pa and filled with high purity argon gas as protective gas. The pure Ti ingot was first melted to further reduce the oxygen content in the furnace chamber, and then the melting of the alloy was carried out with a melting current ranging from 20 A to 500 A. During the melting process, electromagnetic stirring was used to homogenize the alloy. After the alloy ingot was cooled, the alloy ingot was flipped and remelted for 4 times to obtain a master alloy ingot.

(3) Casting: The master alloy ingot was placed in the high vacuum arc melting and casting apparatus, and the furnace chamber was evacuated to $2.5\times10^{-3}$ Pa and filled with high purity argon gas. Under the protection of argon, the master alloy ingot was heated to 1600° C. with a melting current ranging from 20 A to 500 A. After the master alloy ingot was completely melted, the liquid alloy was cast into a copper mold and cooled to obtain a high entropy alloy ingot.

(4) Solution treatment: The high entropy alloy ingot was cleaned with acetone by ultrasonic cleaning machines, and then vacuum-sealed and filled with argon. The high entropy alloy ingot was heated to 1200° C. at a heating rate of 10° C./min in a furnace, and held at that temperature for 24 h. Thereafter, the sample was taken out and water quenched to obtain a solid solution state high entropy alloy.

(5) Deformation treatment: The solid solution state high entropy alloy was deformed by rolling at room temperature by multi-pass rolling with 0.5 mm reduction in each pass and a rolling speed of 0.1 m/s for a total deformation of 70%, thereby obtaining a rolled high entropy alloy.

(6) Aging treatment: The rolled high entropy alloy was subjected to heat treatment for 1 h at 600° C., and then air-cooled to obtain the high entropy alloy 2.

Figure 3:
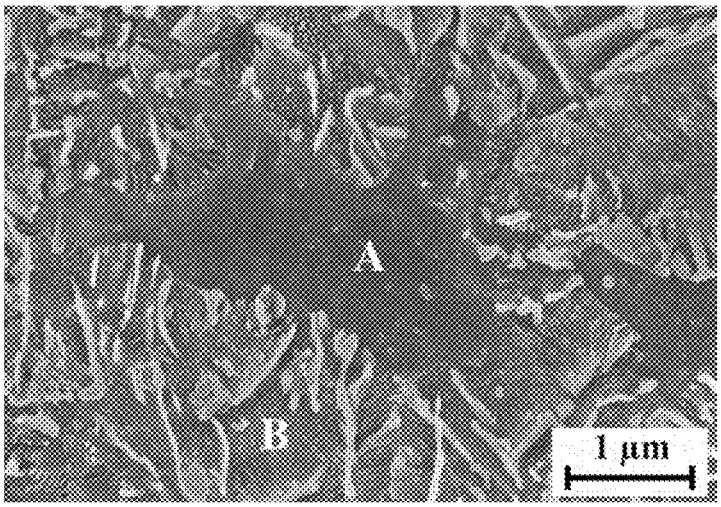
FIG. 3 is a scanning electron microscope image of the high entropy alloy 2 prepared in the example 2.

It can be seen from the XRD spectrum shown in FIG. 1 that the prepared high entropy alloy 2 is composed of FCC phase and $L1_2$ phase. As can be seen from the SEM image shown in FIG. 3, the prepared high entropy alloy 2 is composed of two regions of A and B and the average grain size is 1.3 μm. region A is the matrix FCC phase, and region B is a region where the FCC phase and the $L1_2$ phase are alternately arranged. According to the results of the quasi-static tensile mechanical property tests in FIG. 7 and Table 1, the prepared high entropy alloy 2 possesses a tensile yield strength of 1228 MPa, a tensile strength of 1353 MPa and an elongation of 1.8% at room temperature.

Example 3

The specific preparation steps of the high entropy alloy $Al_{0.5}Cr_{0.55}FeNi_{2.5}V_{0.2}$ (hereinafter referred to as high entropy alloy 3) are as follows:

(1) Raw material preparation: The pure metals Al, Cr, Fe, Ni and V were grinded to remove oxides and other impurities on the surfaces using sandpapers with a grinding machine, and were then successively cleaned with acetone and ethanol by ultrasonic cleaning machines to obtain clean metal elements. Afterwards, the pure metals were accurately weighed according to the chemical formula of the high entropy alloy in this example for a total mass of 80 g.

(2) Melting: The cleaned pure metals were stacked inside the water-cooled copper crucible of the high vacuum non-consumable arc melting furnace from bottom to top according to the order of their respective melting points from low to high. Then the furnace chamber was evacuated to $2.5\times10^{-3}$ Pa and filled with high purity argon gas as protective gas. The pure Ti ingot was first melted to further reduce the oxygen content in the furnace chamber, and then the melting of the alloy was carried out with a melting current ranging from 20 A to 500 A. During the melting process, electromagnetic stirring was used to homogenize the alloy. After the alloy ingot was cooled, the alloy ingot was flipped and remelted for 4 times to obtain a master alloy ingot.

(3) Casting: The master alloy ingot was placed in the high vacuum arc melting and casting apparatus, and the furnace chamber was evacuated to $2.5\times10^{-3}$ Pa and filled with high purity argon gas. Under the protection of argon, the master alloy ingot was heated to 1600° C. with a melting current ranging from 20 A to 500 A. After the master alloy ingot was completely melted, the liquid alloy was cast into a copper mold and cooled to obtain a high entropy alloy ingot.

(4) Solution treatment: The high entropy alloy ingot was cleaned with acetone by ultrasonic cleaning machines, and then vacuum-sealed and filled with argon. The high entropy alloy ingot was heated to 1200° C. at a heating rate of 10° C./min in a furnace, and held at that temperature for 24 h. Thereafter, the sample was taken out and water quenched to obtain a solid solution state high entropy alloy.

(5) Deformation treatment: The solid solution state high entropy alloy was deformed by rolling at room temperature by multi-pass rolling with 0.5 mm reduction in each pass and a rolling speed of 0.1 m/s for a total deformation of 60%, thereby obtaining a rolled high entropy alloy.

(6) Aging treatment: The rolled high entropy alloy was subjected to heat treatment for 1 h at 600° C., and then air-cooled to obtain the high entropy alloy 3.

Figure 4:
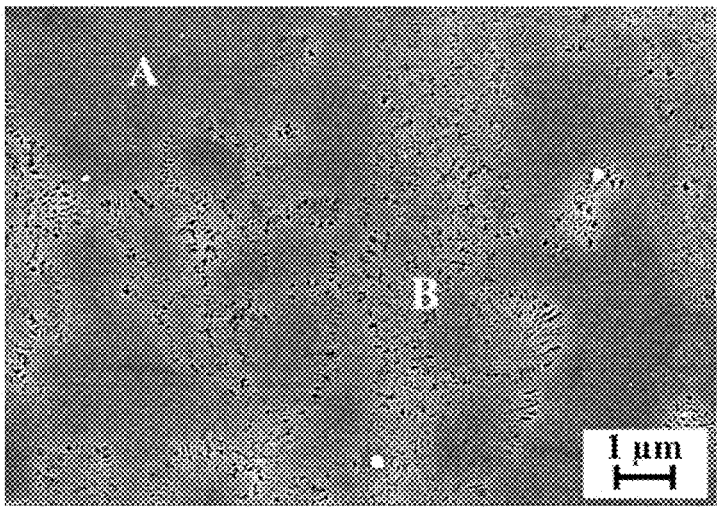
FIG. 4 is a scanning electron microscope image of the high entropy alloy 3 prepared in the example 3.

It can be seen from the XRD spectrum shown in FIG. 1 that the prepared high entropy alloy 3 is composed of FCC phase and $L1_2$ phase. As can be seen from the SEM image shown in FIG. 4, the prepared high entropy alloy 3 is composed of two regions of A and B and the average grain size is 1.2 μm. Region A is the matrix FCC phase, and region B is a region where the FCC phase and the $L1_2$ phase are alternately arranged. According to the results of the quasi-static tensile mechanical property tests in FIG. 7 and Table 1, the prepared high entropy alloy 3 possesses a tensile yield strength of 1307 MPa, a tensile strength of 1393 MPa and an elongation of 2.0% at room temperature.

Example 4

The specific preparation steps of the high entropy alloy $Al_{0.4}Cr_{0.32}Fe_{0.8}Ni_2V_{0.16}$ (hereinafter referred to as high entropy alloy 4) are as follows:

(1) Raw material preparation: The pure metals Al, Cr, Fe, Ni and V were grinded to remove oxides and other impurities on the surfaces using sandpapers with a grinding machine, and were then successively cleaned with acetone and ethanol by ultrasonic cleaning machines to obtain clean metal elements. Afterwards, the pure metals were accurately weighed according to the chemical formula of the high entropy alloy in this example for a total mass of 80 g.

(2) Melting: The cleaned pure metals were stacked inside the water-cooled copper crucible of the high vacuum non-consumable arc melting furnace from bottom to top according to the order of their respective melting points from low to high. Then the furnace chamber was evacuated to $2.5\times10^{-3}$ Pa and filled with high purity argon gas as protective gas. The pure Ti ingot was first melted to further reduce the oxygen content in the furnace chamber, and then the melting of the alloy was carried out with a melting current ranging from 20 A to 500 A. During the melting process, electromagnetic stirring was used to homogenize the alloy. After the alloy ingot was cooled, the alloy ingot was flipped and remelted for 4 times to obtain a master alloy ingot.

(3) Casting: The master alloy ingot was placed in the high vacuum arc melting and casting apparatus, and the furnace chamber was evacuated to $2.5\times10^{-3}$ Pa and filled with high purity argon gas. Under the protection of argon, the master alloy ingot was heated to 1600° C. with a melting current ranging from 20 A to 500 A. After the master alloy ingot was completely melted, the liquid alloy was cast into a copper mold and cooled to obtain a high entropy alloy ingot.

(4) Solution treatment: The high entropy alloy ingot was cleaned with acetone by ultrasonic cleaning machines, and then vacuum-sealed and filled with argon. The high entropy alloy ingot was heated to 1250° C. at a heating rate of 10° C./min in a furnace, and held at that temperature for 24 h. Thereafter, the sample was taken out and water quenched to obtain a solid solution state high entropy alloy.

(5) Deformation treatment: The solid solution state high entropy alloy was deformed by rolling at room temperature by multi-pass rolling with 0.5 mm reduction in each pass and a rolling speed of 0.1 m/s for a total deformation of 70%, thereby obtaining a rolled high entropy alloy.

(6) Aging treatment: The rolled high entropy alloy was subjected to heat treatment for 5 h at 600° C., and then air-cooled to obtain the high entropy alloy 4.

Figure 5:
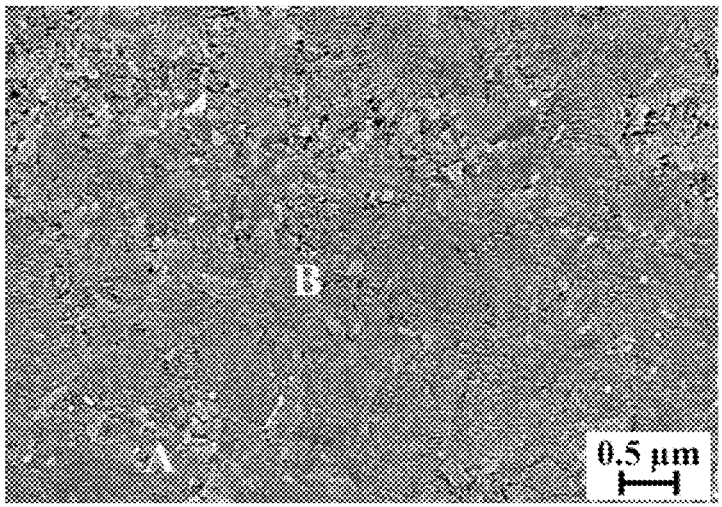
FIG. 5 is a scanning electron microscope image of the high entropy alloy 4 prepared in the example 4.

It can be seen from the XRD spectrum shown in FIG. 1 that the prepared high entropy alloy 4 is composed of FCC phase and $L1_2$ phase. As can be seen from the SEM image shown in FIG. 5, the prepared high entropy alloy 4 is composed of two regions of A and B and the average grain size is 0.8 μm. Region A is the matrix FCC phase, and region B is a region where the FCC phase and the $L1_2$ phase are alternately arranged. According to the results of the quasi-static tensile mechanical property tests in FIG. 7 and Table 1, the prepared high entropy alloy 4 possesses a tensile yield strength of 1204 MPa, a tensile strength of 1318 MPa and an elongation of 4.4% at room temperature.

Example 5

The specific preparation steps of the high entropy alloy $Al_{0.5}Cr_{0.37}FeNi_{3.18}V_{0.21}$ (hereinafter referred to as high entropy alloy 5) are as follows:

(1) Raw material preparation: The pure metals Al, Cr, Fe, Ni and V were grinded to remove oxides and other impurities on the surfaces using sandpapers with a grinding machine, and were then successively cleaned with acetone and ethanol by ultrasonic cleaning machines to obtain clean metal elements. Afterwards, the pure metals were accurately weighed according to the chemical formula of the high entropy alloy in this example for a total mass of 80 g.

(2) Melting: The cleaned pure metals were stacked inside the water-cooled copper crucible of the high vacuum non-consumable arc melting furnace from bottom to top according to the order of their respective melting points from low to high. Then the furnace chamber was evacuated to $2.5\times10^{-3}$ Pa and filled with high purity argon gas as protective gas. The pure Ti ingot was first melted to further reduce the oxygen content in the furnace chamber, and then the melting of the alloy was carried out with a melting current ranging from 20 A to 500 A. During the melting process, electromagnetic stirring was used to homogenize the alloy. After the alloy ingot was cooled, the alloy ingot was flipped and remelted for 4 times to obtain a master alloy ingot.

(3) Casting: The master alloy ingot was placed in the high vacuum arc melting and casting apparatus, and the furnace chamber was evacuated to $2.5\times10^{-3}$ Pa and filled with high purity argon gas. Under the protection of argon, the master alloy ingot was heated to 1600° C. with a melting current ranging from 20 A to 500 A. After the master alloy ingot was completely melted, the liquid alloy was cast into a copper mold and cooled to obtain a high entropy alloy ingot.

(4) Solution treatment: The high entropy alloy ingot was cleaned with acetone by ultrasonic cleaning machines, and then vacuum-sealed and filled with argon. The high entropy alloy ingot was heated to 1250° C. at a heating rate of 10° C./min in a furnace, and held at that temperature for 24 h. Thereafter, the sample was taken out and water quenched to obtain a solid solution state high entropy alloy.

(5) Deformation treatment: The solid solution state high entropy alloy was deformed by rolling at room temperature by multi-pass rolling with 0.5 mm reduction in each pass and a rolling speed of 0.1 m/s for a total deformation of 75%, thereby obtaining a rolled high entropy alloy.

(6) Aging treatment: The rolled high entropy alloy was subjected to heat treatment for 1 h at 700° C., and then air-cooled to obtain the high entropy alloy 5.

Figure 6:
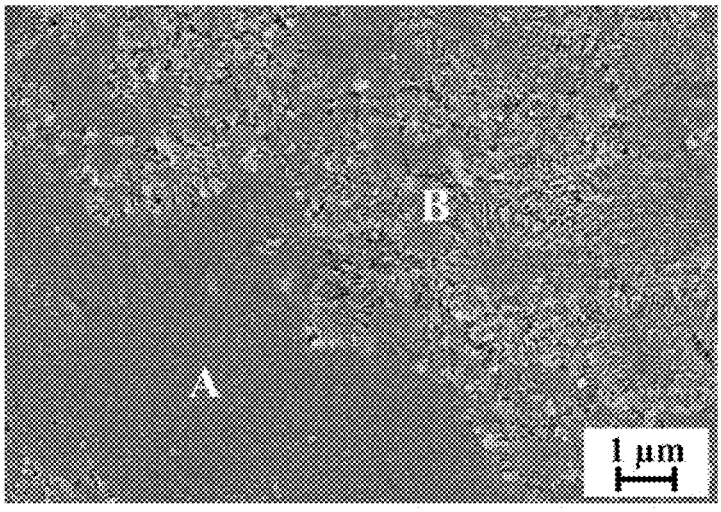
FIG. 6 is a scanning electron microscope image of the high entropy alloy 5 prepared in the example 5.

It can be seen from the XRD spectrum shown in FIG. 1 that the prepared high entropy alloy 5 is composed of FCC phase and $L1_2$ phase. As can be seen from the SEM image shown in FIG. 6, the prepared high entropy alloy 5 is composed of two regions of A and B and the average grain size is 1.2 μm. Region A is the matrix FCC phase, and region B is a region where the FCC phase and the $L1_2$ phase are alternately arranged. According to the results of the quasi-static tensile mechanical property tests in FIG. 7 and Table 1, the prepared high entropy alloy 5 possesses a tensile yield strength of 1407 MPa, a tensile strength of 1490 MPa and an elongation of 3.6% at room temperature.

TABLE 1

| Sample No. | Yield strength ($\sigma_{0.2}$/MPa) | Tensile strength ($\sigma_b$/MPa) | Elongation (%) |
|---|---|---|---|
| High entropy alloy 1 | 1283 | 1377 | 2.2 |
| High entropy alloy 2 | 1228 | 1353 | 1.8 |
| High entropy alloy 3 | 1307 | 1393 | 2.0 |
| High entropy alloy 4 | 1260 | 1396 | 3.1 |
| High entropy alloy 5 | 1407 | 1490 | 3.6 |

To sum up, the foregoing is only the preferred embodiments of the present invention and is not intended to limit the protection scope of the present invention. Any modification, equivalent substitutions, improvement, etc. within the spirit and principle of the present invention should be included in the protection scope of the present invention.

The invention claimed is:

1. A precipitation strengthening AlCrFeNiV system alloy denoted as $Al_aCr_bFe_cNi_dV_e$, wherein a=0.38, b=0.69, c=0.60, d=2.12, e=0.17 or a=0.30-0.55, b=0.30-0.55, c=0.84-1.10, d=2.00-3.50, e=0.10-0.22, wherein the alloy is composed mainly with an FCC phase and further comprises an $L1_2$ phase precipitated coherently with the FCC phase, and wherein the alloy has a yield strength and a tensile strength higher than 1200 MPa and 1300 MPa, respectively.

* * * * *